US006819302B2

(12) United States Patent
Volman

(10) Patent No.: US 6,819,302 B2
(45) Date of Patent: Nov. 16, 2004

(54) DUAL PORT HELICAL-DIPOLE ANTENNA AND ARRAY

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/346,401

(22) Filed: Jan. 15, 2003

(65) Prior Publication Data

US 2004/0135732 A1 Jul. 15, 2004

(51) Int. Cl.[7] ..... H01Q 1/36
(52) U.S. Cl. ..... 343/895; 343/702
(58) Field of Search ..... 343/895, 702

(56) References Cited

U.S. PATENT DOCUMENTS 6,172,655 B1 1/2001 Volman ..... 343/895
6,320,550 B1 * 11/2001 Van Voorhies ..... 343/895
2003/0030594 A1 * 2/2003 Larry ..... 343/895

* cited by examiner

*Primary Examiner*—Wilson Lee
(74) *Attorney, Agent, or Firm*—McDermott Will & Emery LLP

(57) ABSTRACT

A high gain dual port antenna and antenna array provide enhanced isolation between a receiver and a transmitter. The antenna includes a helical element connected to one port and a dipole element positioned within the helical element and connected to a second port. The helical element can have a uniform diameter or varying diameters, while the dipole element is preferably a Z-shape for accommodation within the helical element.

22 Claims, 17 Drawing Sheets

HELIX WITH Z-SHAPED DIPOLE

EQUIVALENT CIRCUIT OF MULTIFOLD DIPLEXER

EQUIVALENT CIRCUIT OF DIRECTIONAL FILTER MULTIPLEXER

FEED WITH DUAL PORT HELIX

HELIX WITH Z-SHAPED DIPOLE

PATTERN DIAGRAM OF DUAL PORT HELIX: DIPOLE EXCITATION

AXIAL RATIO OF DUAL PORT HELIX: DIPOLE EXCITATION

PATTERN DIAGRAM OF DUAL PORT HELIX: HELIX EXCITATION

PATTERN DIAGRAM OF DUAL PORT HELIX: HELIX EXCITATION

CLUSTER OF SEVEN DUAL PORT HELICES

PATTERN DIAGRAM OF DUAL PORT HELIX: DIPOLE EXCITATION

AXIAL RATIO OF DUAL PORT HELIX: DIPOLE EXCITATION

PATTERN DIAGRAM OF DUAL PORT HELIX: HELIX EXCITATION

AXIAL RATIO OF DUAL PORT HELIX: HELIX EXCITATION

CLUSTER OF SEVEN DUAL HELICES WITH ROTATION SYMMETRY

PATTERN DIAGRAM OF DUAL PORT HELIX: DIPOLE EXCITATION

AXIAL RATIO OF DUAL PORT HELIX: DIPOLE EXCITATION

PATTERN DIAGRAM OF DUAL PORT HELIX: HELIX EXCITATION

AXIAL RATIO OF DUAL PORT HELIX: HELIX EXCITATION

DUAL PORT HELICAL-DIPOLE ANTENNA AND ARRAY

STATEMENT AS TO RIGHTS TO INVENTIONS MADE UNDER FEDERALLY SPONSORED RESEARCH OR DEVELOPMENT

NOT APPLICABLE

BACKGROUND OF THE INVENTION

This invention relates generally to antennas for wireless communications, and more particularly the invention relates to a compact antenna structure which provides improved RF isolation between a receiver and a transmitter sharing the antenna.

High gain antennas are widely used for communication purposes and for radar or other sensing use. In general, high antenna gains are associated with high directivity, which in turn arises from a large radiating aperture. A common method for achieving a large radiating aperture is through the use of parabolic reflectors fed by a feed subarray located at the focal point of the parabolic reflector. Modern communication and sensing systems are finding increasing use for antenna arrays for high gain use. An antenna array includes an array of usually identical antennas or elements, each of which ordinarily has lower gain than the array antenna as a whole. A salient advantage of an array antenna is the ability to scan the beam or beams electronically without physically moving the mass of the reflector or array.

A circularly polarized antenna element used for circular polarization is described in Volman U.S. Pat. No. 6,172,655, issued Jan. 9, 2001. This patent describes an array antenna in which circular polarization is achieved by the use of ultra short axial mode helical antenna elements. In the Volman arrangement, the axial mode helical antenna element has a one-port design, that is the transmitter and receiver are connected to the antenna through the same port. The one-port helical antenna requires multiplex equipment for combination or separation of frequency bands in order to provide separation/combination of the receive and transmit bands. The receive/transmit band of multiplexers for space communication systems must provide extremely high isolation between the bands (on the order of 120 dB or higher) owing to the large difference of the receive and transmit signal levels. Further, the lowest possible insertion loss, mass, and size must be provided along with high power handling capability without multipactor breakdown. Additionally, pulse interval modulation (PIM) must be reduced to a level below 180 dB.

FIG. 1 is a functional block diagram of a conventional multifold diplexer for connecting a transmit signal from filter 10 to antenna 12 and connecting a received signal through receiver filter 12. The receiver and transmitter filters are tuned respectively to the receive frequency band and the transmit frequency band that are directly connected to the T-junction 16 of the antenna. However, in this arrangement almost full transmitter power goes straight to the receiver filter. In order to mitigate the PIM and multipactor effects, the receiver filter must handle the full transmitter power level, which presents a high risk element with extra mass, size, and weight in the antenna. Further, the coaxial T-junction used at UHF and other frequency bands is a high risk element because of possible PIM problems.

FIG. 2 is a functional block diagram of a conventional diplexer with directional filter modules. This arrangement requires two receive filters 20, 22, a first hybrid 24 for connecting the receive filters to a receiver, and a second hybrid 26 for connecting the receiver channel and transmit filter 28 in the transmit channel to the transmit/receive antenna. This arrangement has high manufacturing and tuning expense as well as high mass and large size. This arrangement does provide approximately 20 dB of increased isolation between the transmitter output and receiver input when compared to the manifold diplexer of FIG. 1. However, full transmitter power again goes to the receive filter input, thus creating the possibility of PIM and multipactor problems.

BRIEF SUMMARY OF THE INVENTION

In accordance with the invention, a dual port antenna and array are provided for increased RF isolation between the receiver channel and the transmitter channel and between the receive and transmit frequency bands.

The antenna includes a helical antenna element and a dipole element inside of the helical element, without touching the helix, and with a separate port to each element. The helical element is supported by and extends from a ground plane, and the dipole is located about a quarter wavelength (receive band) above the ground plane. Advantageously, a balan/two wire line for the port to the dipole element can be printed on a printed circuit board of the ground plane support structure.

The two ports eliminate any galvanic contact between the transmitter and receiver circuits. Lower mass and a compact size are realized with the structure which leads to greater flexibility and packaging and thermal environment in a spacecraft application, for example.

The invention and objects and features thereof will be more readily apparent from the following detailed description and appended claims when taken with the drawings.

DETAILED DESCRIPTION OF ILLUSTRATIVE EMBODIMENTS

Figure 1A:
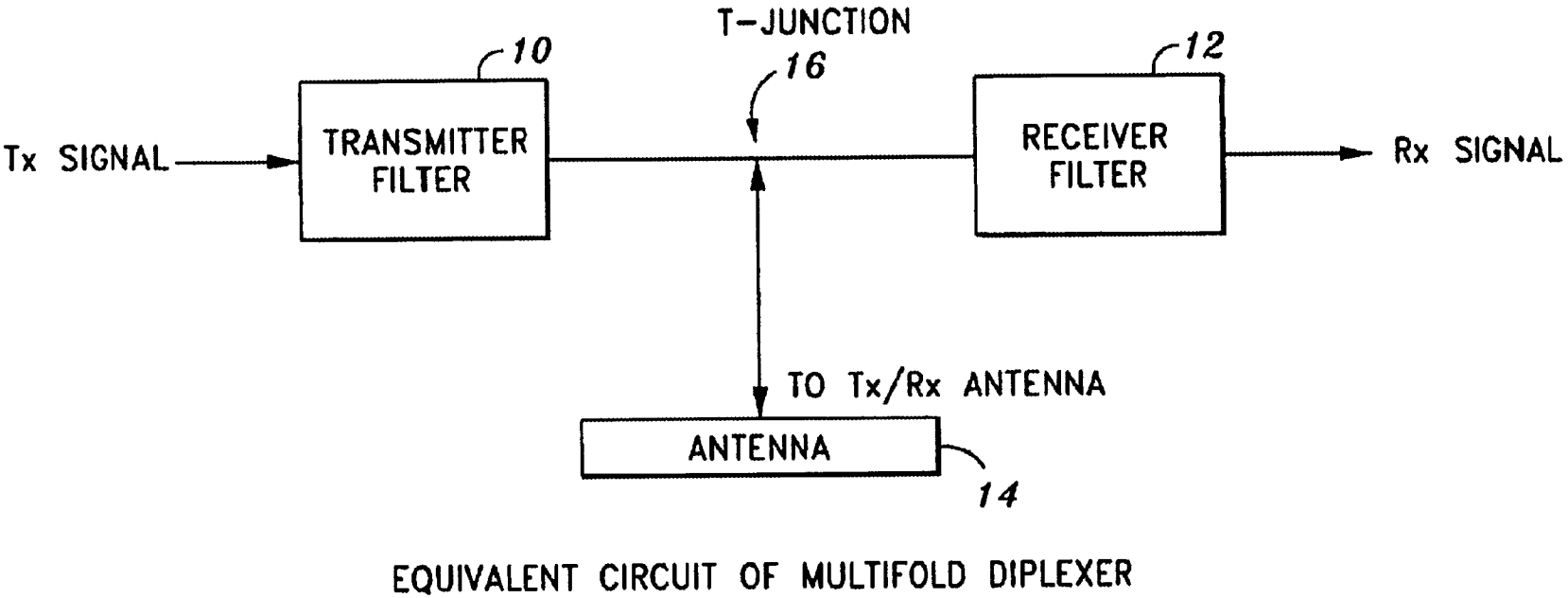
FIG. 1A (PRIOR ART)
FIGS. 1A, 1B are functional block diagrams illustrating equivalent circuits of a multifold diplexer and a directional filter multiplexer, respectively, as used in the prior art.
Figure 1B:
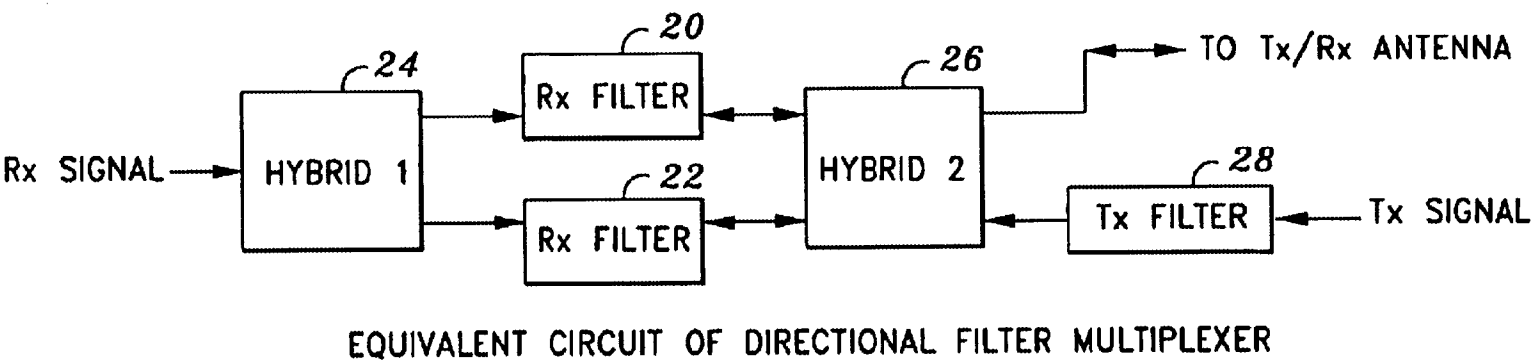
FIG. 1B (PRIOR ART)
Figure 2:
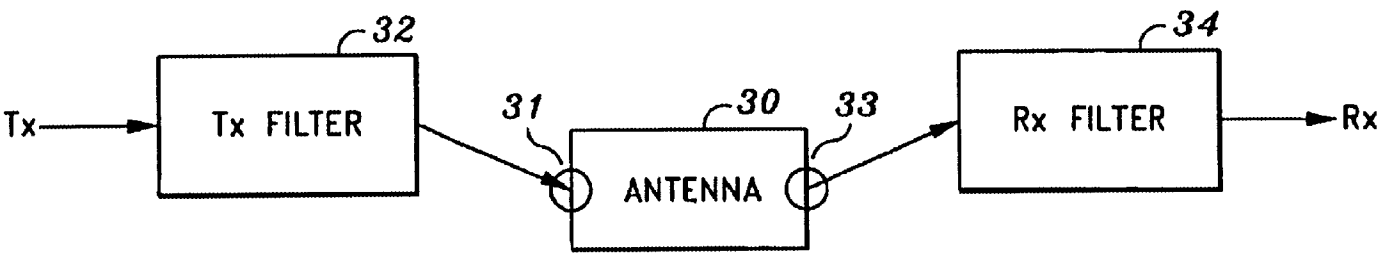
FIG. 2 is a functional block diagram of a dual port antenna connected with a transmit filter and a receive filter, respectively, in accordance with the present invention.

FIG. 2 is a functional block diagram of a dual port antenna in accordance with the invention. Antenna 30 has a first port 31 which is connected to the transmit channel through transmit filter 32, and antenna 30 has a second port 33 which is connected to the receive channel through receive filter 34. The provision of two isolated ports to the antenna creates a more compact structure with a smaller number of components and interconnections which is particularly advantageous in spacecraft and satellite applications. Further, PIM reduction and multipactor performance enhancement are achieved.

Figure 3:
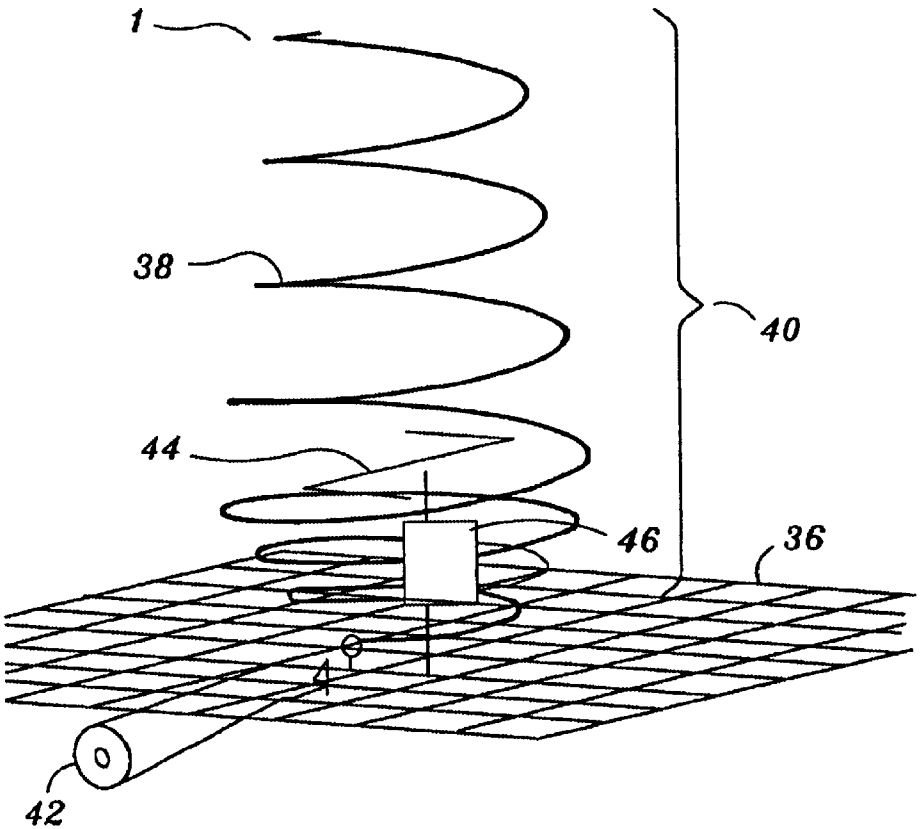
FIG. 3 illustrates a dual port antenna including a helical antenna element and a dipole antenna element, respectively, in accordance with one embodiment of the invention.

FIG. 3 is a more detailed diagram of a dual port helical antenna and dipole in accordance with a preferred embodiment of the invention. The antenna is mounted on a support structure 36 which functions as a ground plane for the antenna. The helical antenna 38 includes a winding shown at 40 with a coaxial feed 42 connected to a feed end 4 of the helical antenna at the support structure, feed end 4 comprising first port 31. Distal end 1 of helical antenna 38 is disposed away from support structure 36. In this embodiment the helical antenna has a uniform diameter through an axis of the helix, but the helical antenna can have a plurality of diameters such as disclosed in Volman U.S. Pat. No. 6,172,655.

A dipole 44 is supportably mounted above support structure 36 disposed inside of the circumference formed by helix 38 without touching the helix winding. The dipole antenna element is connected through a connector, balun/two-wire line 46, which functions as the second port 33 of the antenna. Preferably, dipole antenna 44 is Z-shaped to be accommodated within helical antenna element 38 and is located a quarter wavelength (0.25 λ) at the frequency transmitted by or received by the dipole above ground plane 36. Advantageously, when the ground plane of support structure 36 comprises a printed circuit board metal layer, the balun/two-wire line 46 can be printed in the PCB. Many conventional balun designs can be used, such as the balun disclosed in "Surface Wave Enhanced Broadband Planar Antenna for Wireless Applications," Leong et al., IEEE Microwave and Wireless Components Letters (February 2001). Other dipole configurations can be employed so long as the dipole element can be accommodated within the helical element without touching the helical element and can operate at the desired receive or transmit frequency, which is about one-half of the wavelength of the transmitting or receiving frequency.

By providing two separate ports for the antenna, there is no galvanic contact between the transmitter and receiver circuits, which significantly reduces pulse interval modulation (PIM). According to computer simulation, the RF isolation between the transmitter and receiver is above 14 dB in transmitting frequency band. Thus, the power going from transmitter output to receiver filter will not exceed several hundred watts for the transmitter power level up to 10 kW. This allows a lower mass and compact size for the receiver filter due to the increased isolation between the transmitter and receiver. Further, multipactor breakdown is no longer a problem for the receive filter. This leads to greater flexibility in providing packaging and thermal environment for the filter, particularly in a spacecraft application.

Figure 4:
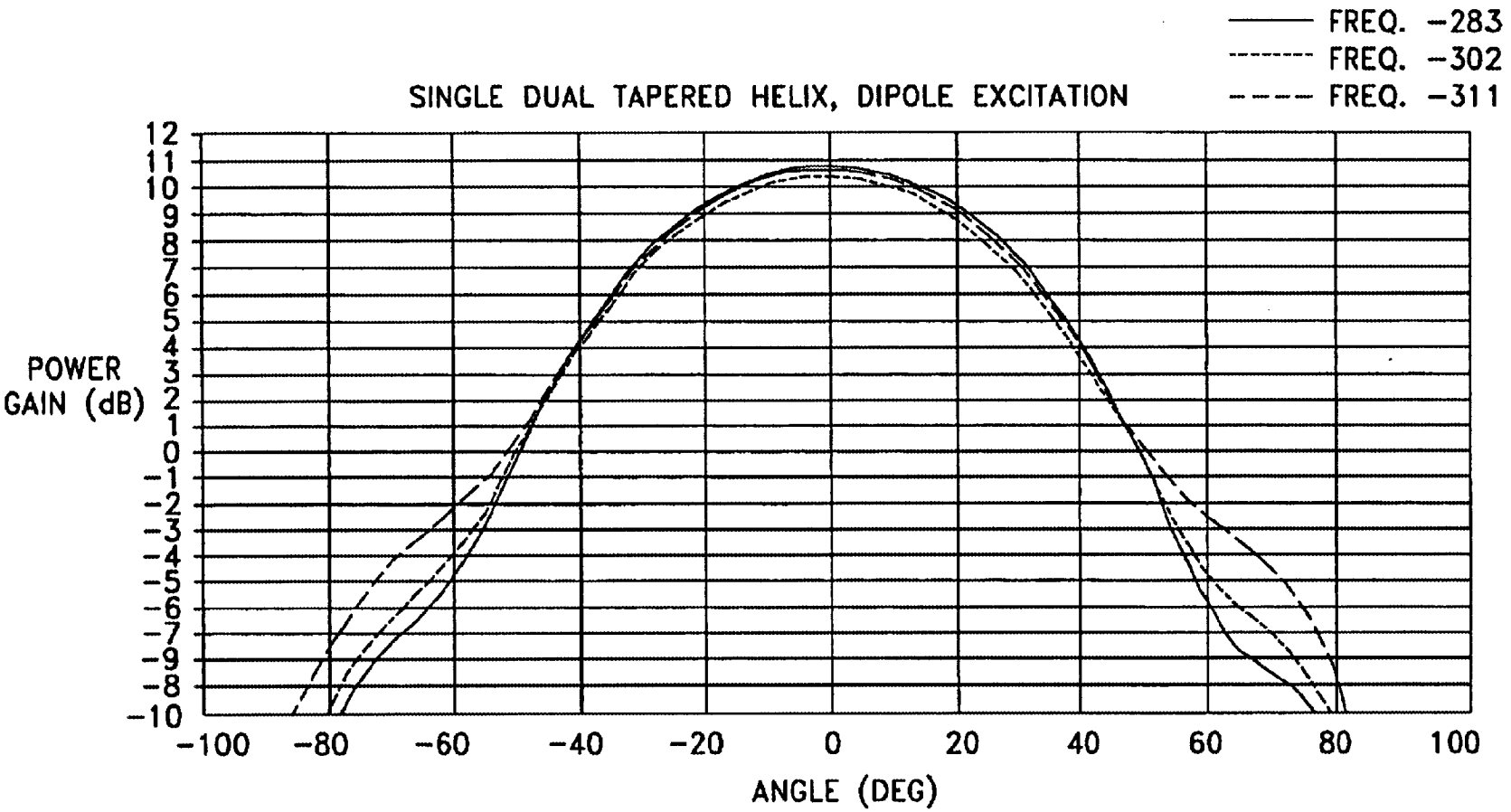
FIG. 4 is a graph of calculated pattern diagrams of the helical element of FIG. 1 for three frequencies between 293 MHz and 311 MHz with a signal generator connected to the dipole element.
Figure 5:
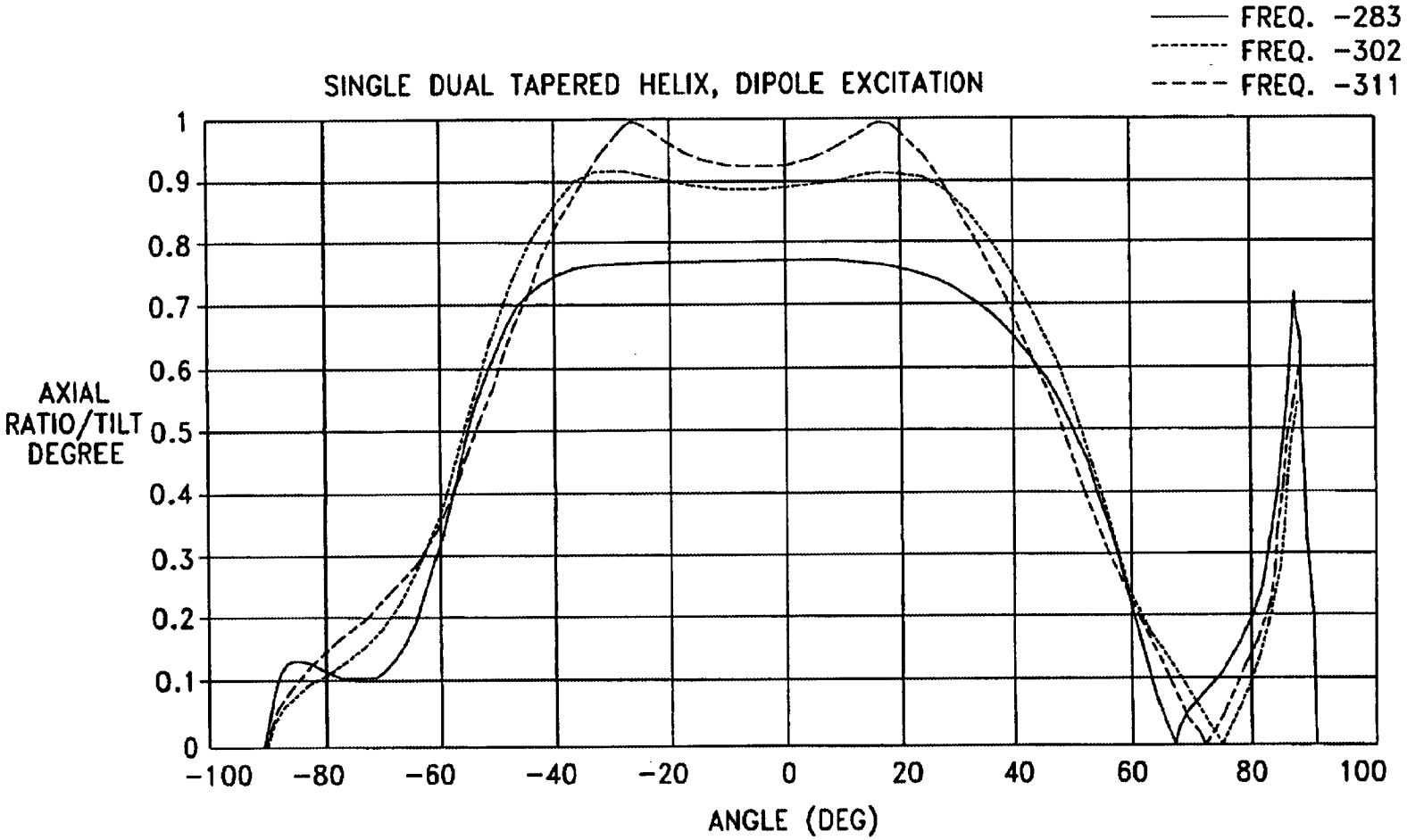
FIG. 5 is a graph illustrating the axial ratio of power gain versus angle at the three frequencies in FIG. 4.

FIG. 4 represents calculated power gain pattern versus angle of reception by the helical element with the dipole connected to the RF signal generator. A peak directivity of about 10.5 dB is realized. For the same excitation, FIG. 5 illustrates the axial ratio as a function of angle at the same frequencies with a value of above 0.75 at any of the frequencies.

Figure 6:
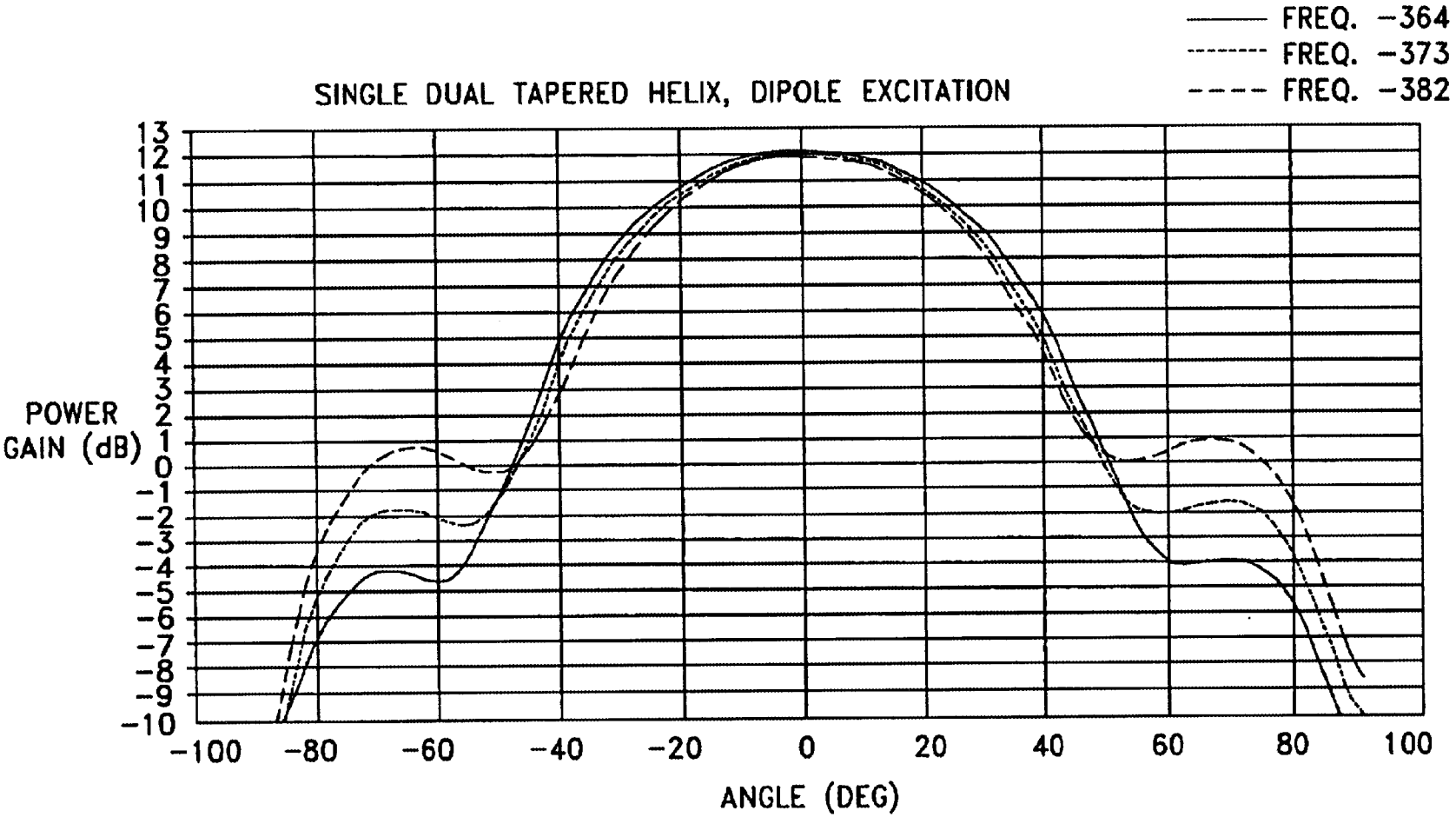
FIG. 6 is a graph illustrating calculated pattern diagrams of the helical element in FIG. 3 for three frequencies between 365 MHz and 382 MHz with the signal generator connected to the helical element.
Figure 7:
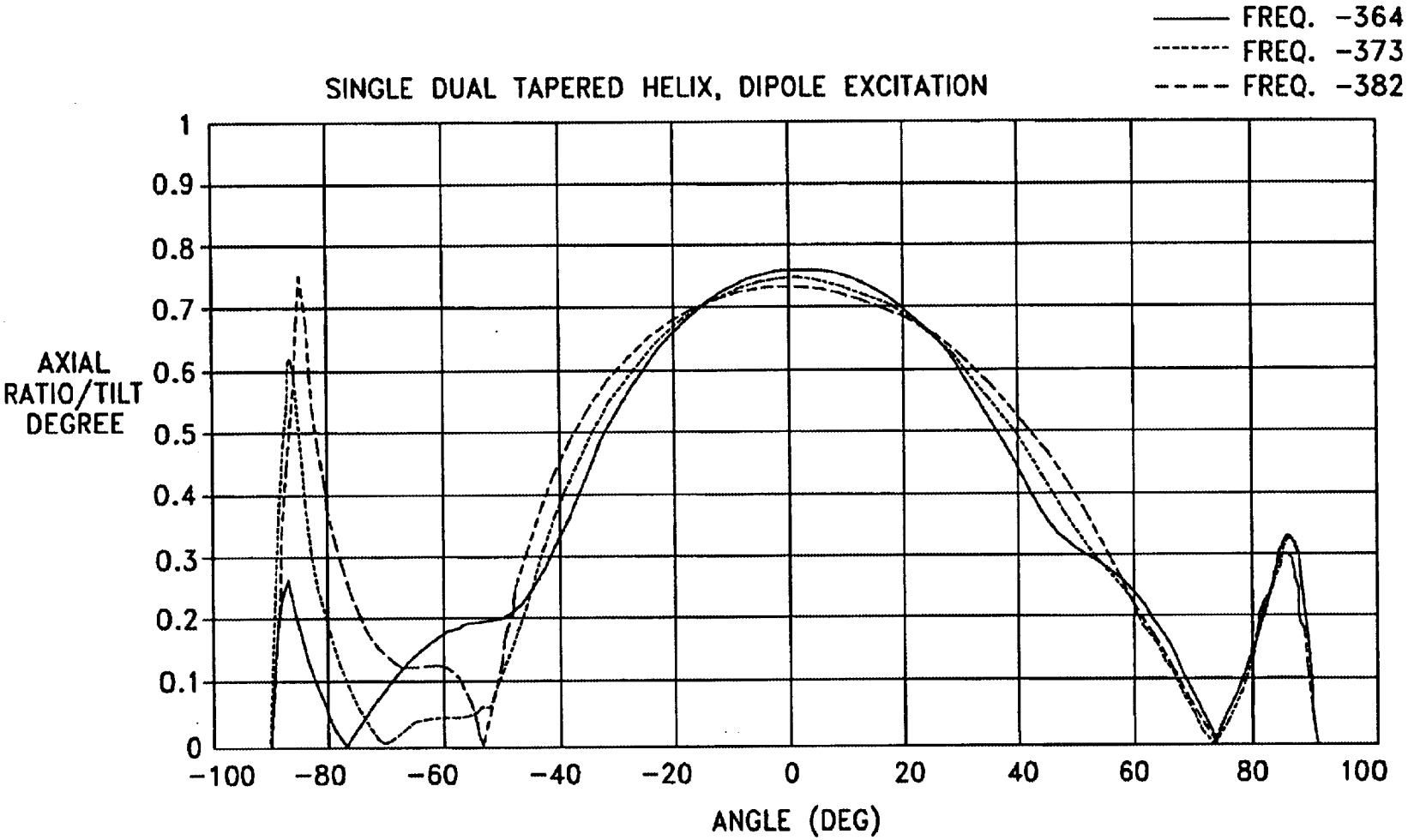
FIG. 7 is a graph illustrating axial ratio as a function of angle at the frequencies of FIG. 6.

FIG. 6 illustrates the calculated pattern diagrams of the helical element for three frequencies between 364 MHz and 382 MHz when the signal generator is connected to the helical antenna element 38. A peak directivity of about 10 dB is realized, and is shown in FIG. 7, for the same excitation the axial ratio as a function of angle at the same frequencies with a value of above 0.88 at any of the frequencies.

Figure 8:
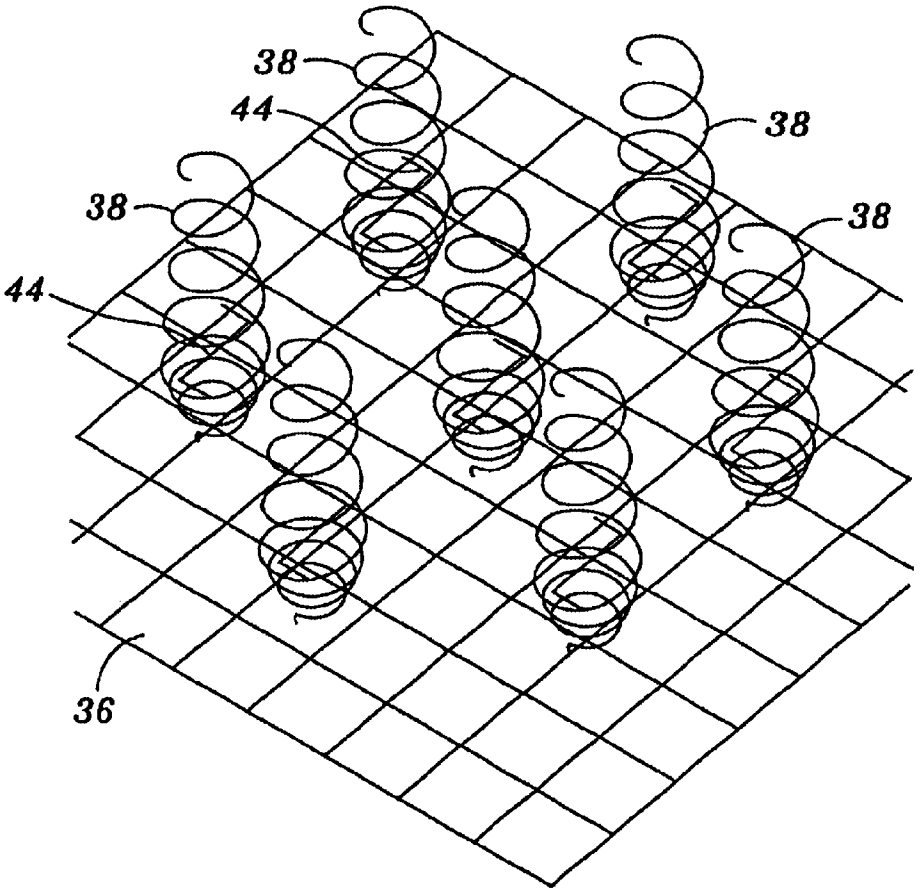
FIG. 8 illustrates an antenna array with antenna elements corresponding to the antenna of FIG. 3 including seven helical elements and dipoles with identical rotational positioning.
Figure 9:
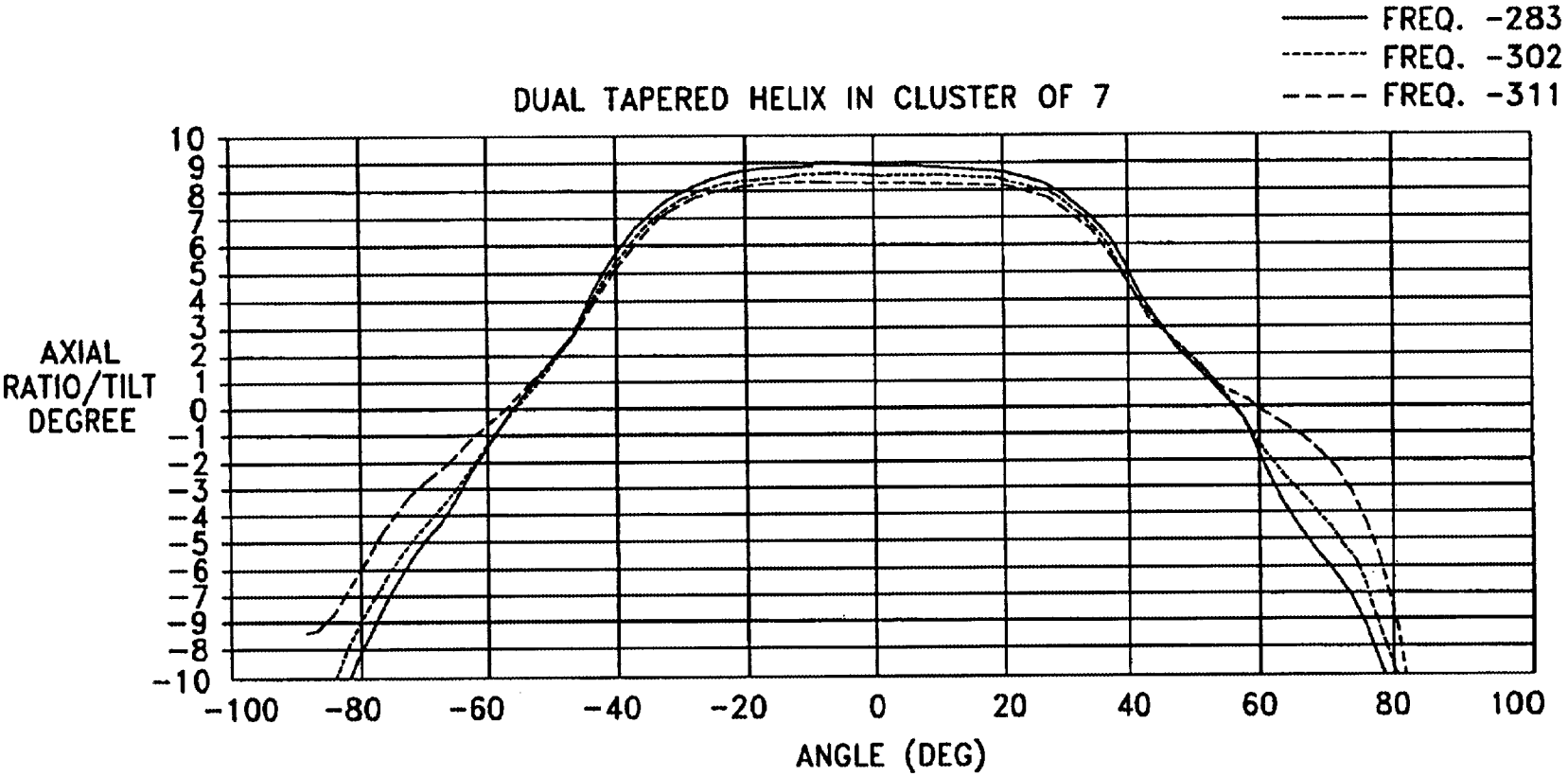
FIG. 9 is a graph illustrating calculated pattern diagrams of power gain versus angle for three frequencies between 293 MHz and 311 MHz with a signal generator connected to the dipoles in FIG. 8.
Figure 10:
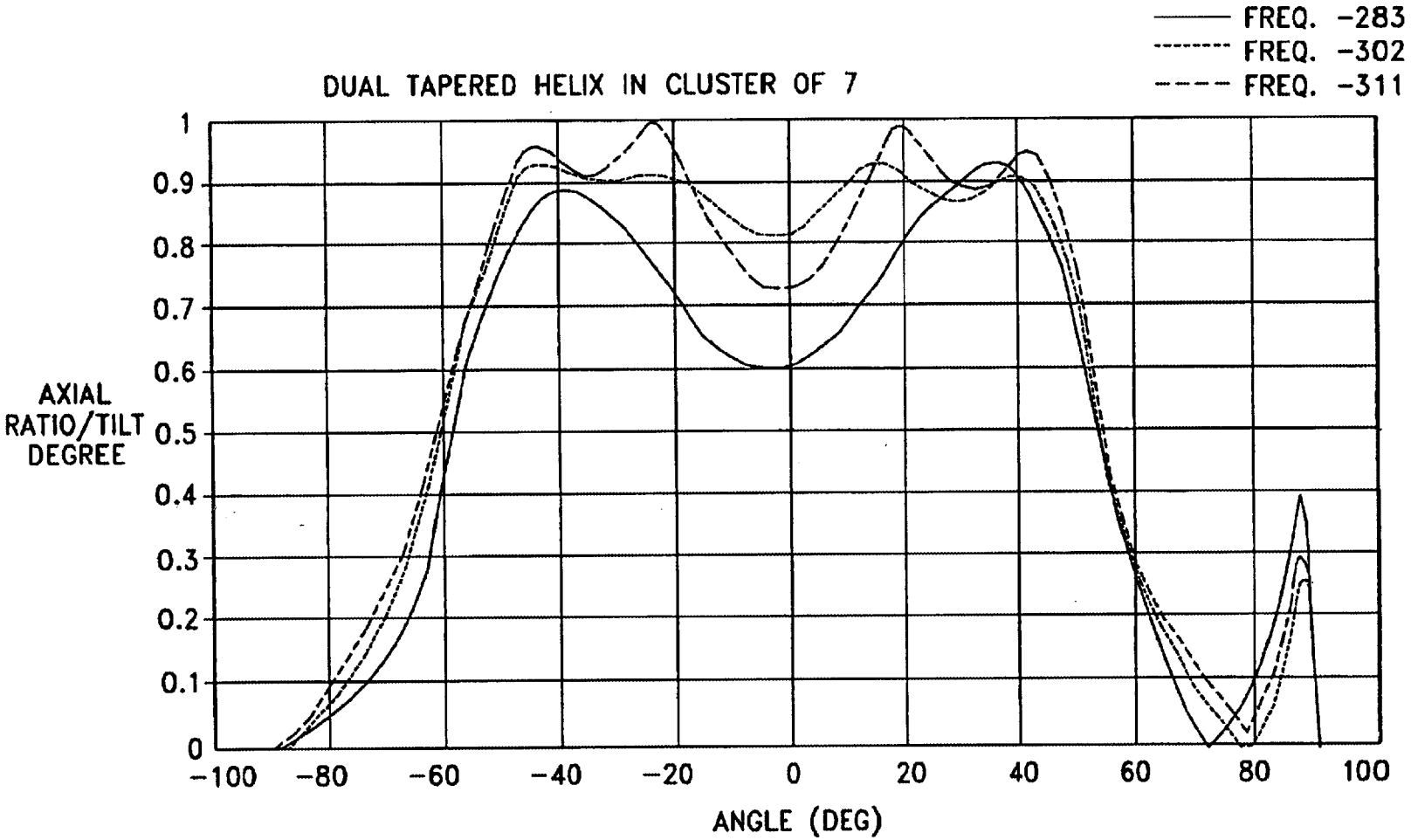
FIG. 10 is a graph illustrating axial ratio as a function of angle at the frequencies in FIG. 9.
Figure 11:
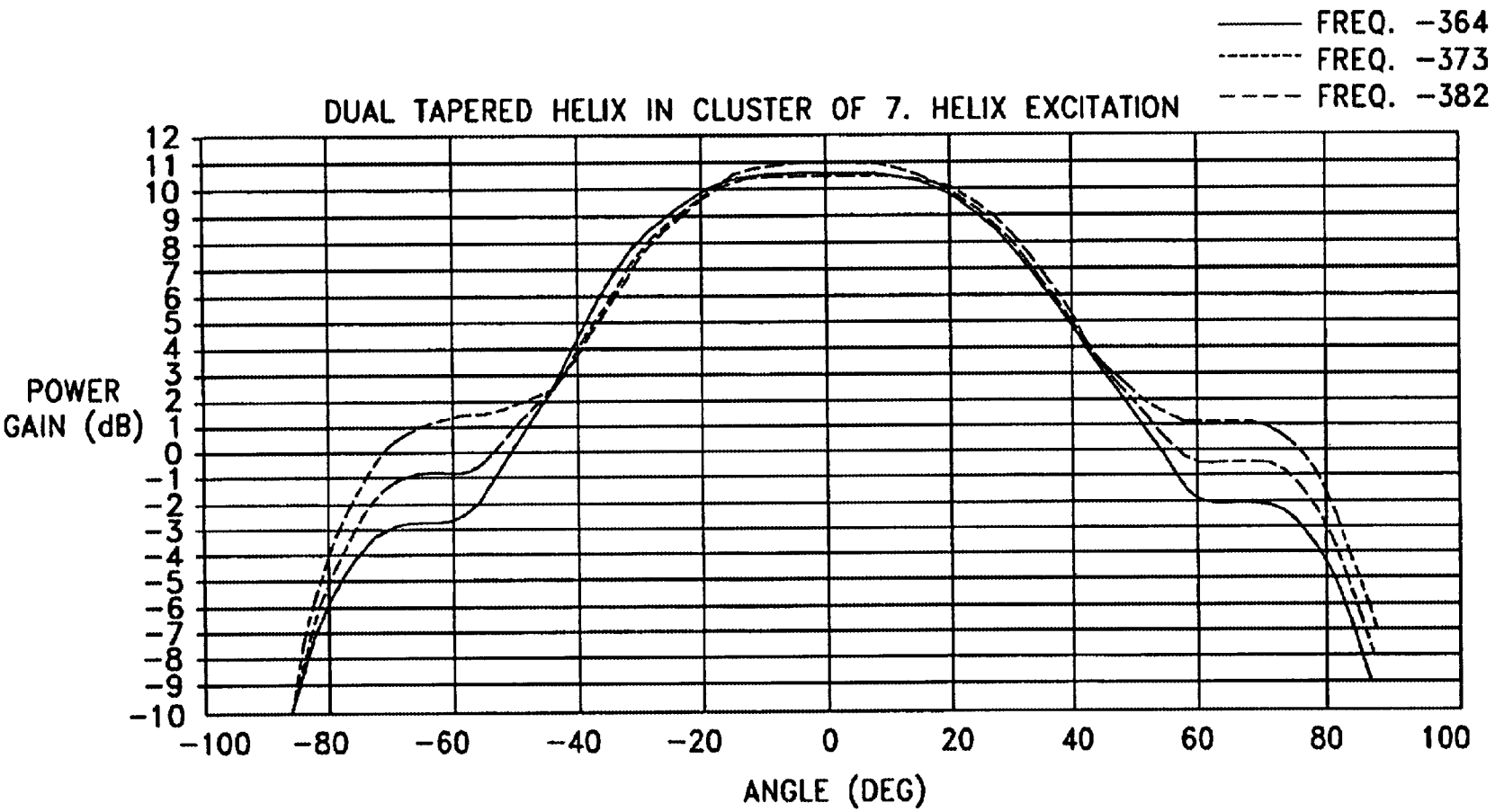
FIG. 11 is a graph illustrating calculated pattern diagrams for the helical elements in FIG. 8 for three frequencies between 364 MHz and 382 MHz with the generator connected to the helical elements.
Figure 12:
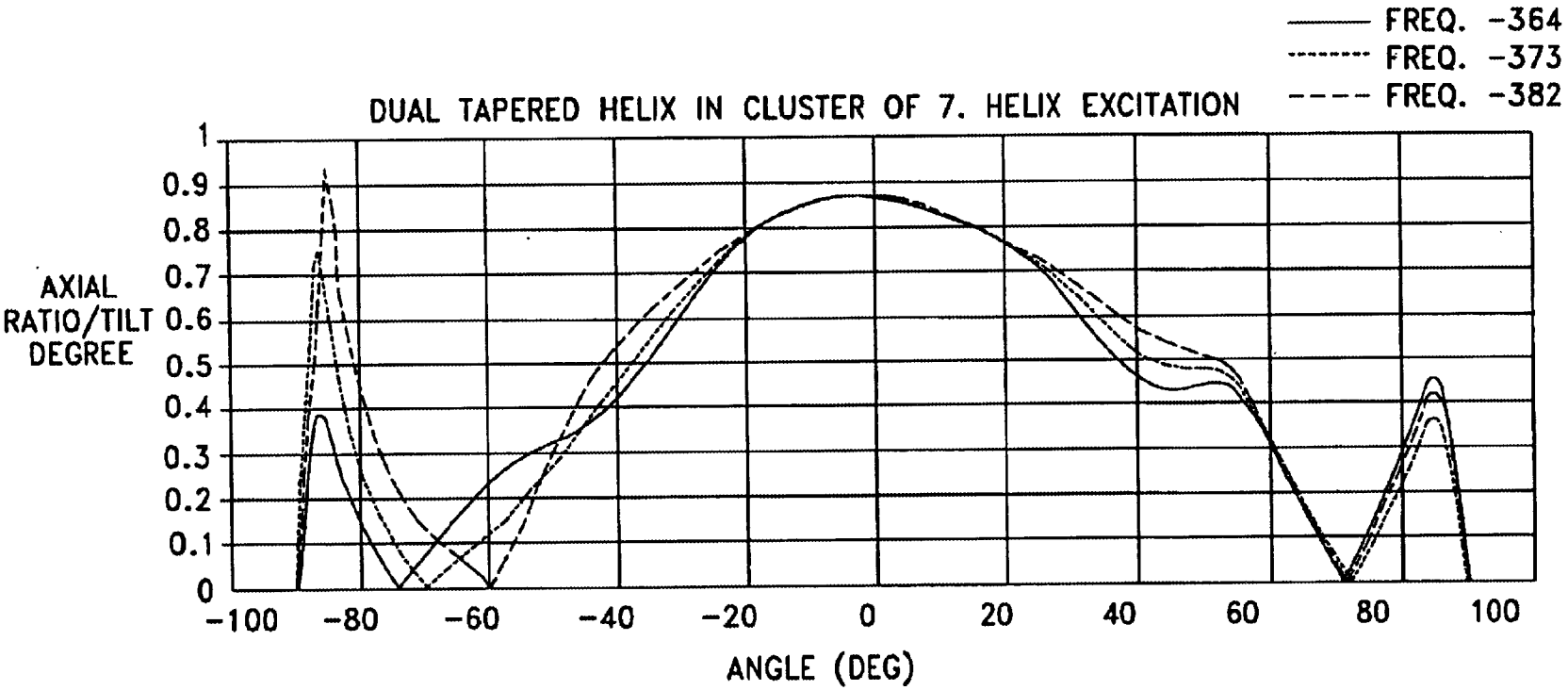
FIG. 12 is a graph illustrating the axial ratio as a function of angle at the same frequencies in FIG. 11.

FIG. 8 is representation of an antenna array in which a plurality of dual port antennas shown in FIG. 3 are mounted on and extend above support structure 36, with the helical elements having identical rotational positioning. FIG. 9 is a graph representing calculated pattern diagrams of one helix 38 in the array for three frequencies between 293 MHz and 311 MHz with the signal generator connected to the Z-shaped dipole 44. A peak directivity of about 8.2–8.8 dB is realized. For the same excitation, FIG. 10 illustrates the axial ratio as a function of angle at the same frequencies and with a value of above 0.6 at any of the frequencies. FIG. 11 is a graph illustrating calculated pattern diagrams of the helical element for three frequencies between 364 MHz and 382 MHz when the signal generator is connected to the helical antenna element port with a peak directivity of about 10.8 dB. For the same excitation, FIG. 12 illustrates the axial ratio as a function of angle at the same frequencies with a value of above 0.86 at any of the frequencies.

Figure 13:
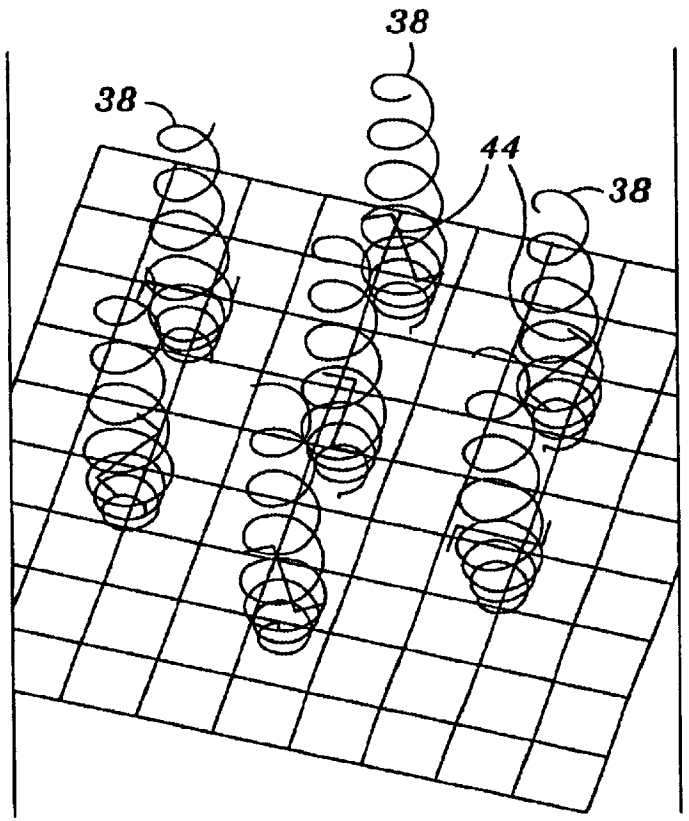
FIG. 13 illustrates an array of helical elements corresponding to the helical element of FIG. 3 including seven helical elements and dipoles with various rotational positioning of the helical elements about their axes.
Figure 14:
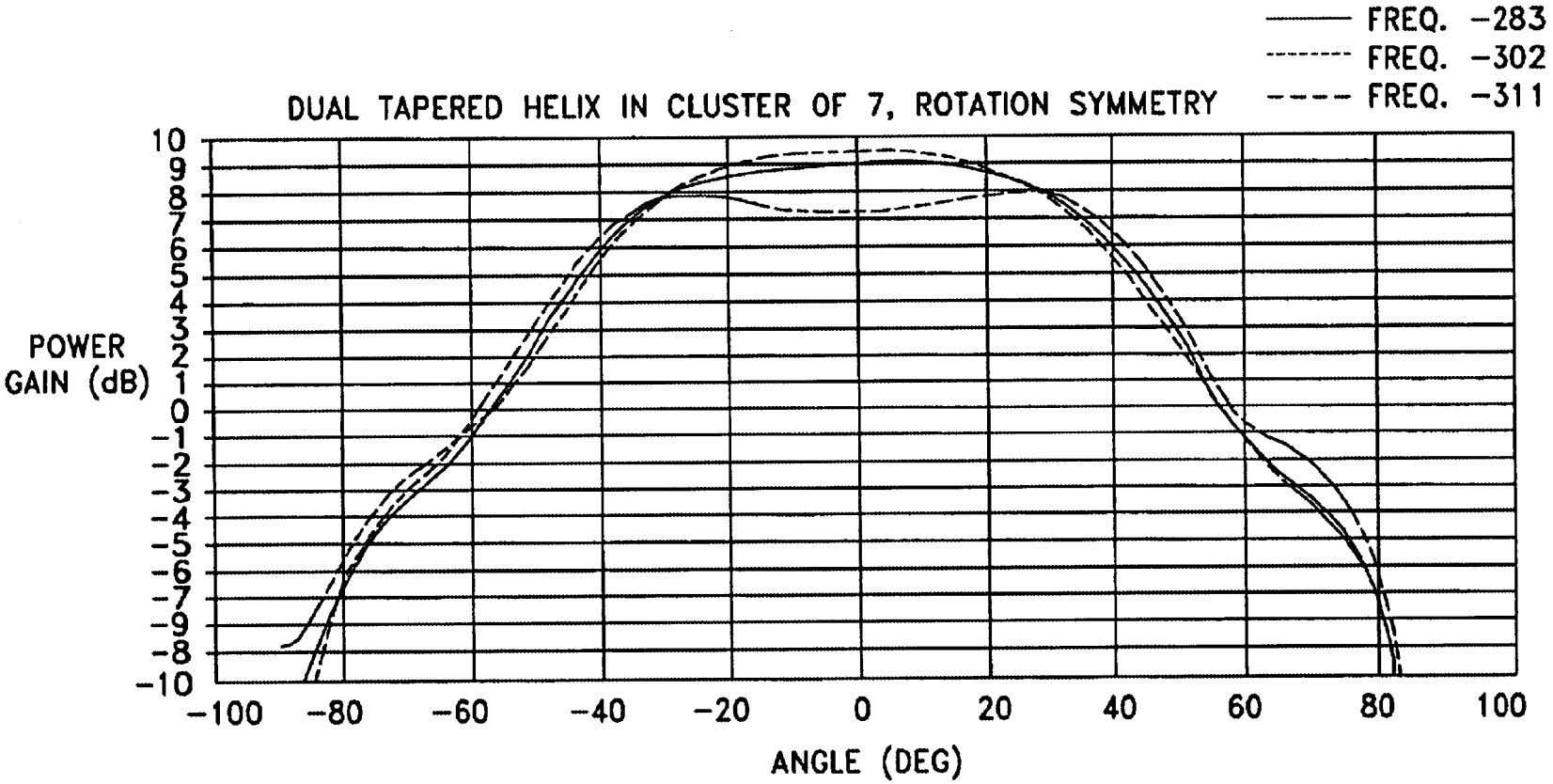
FIG. 14 is a graph illustrating calculated pattern diagrams of the helical elements in FIG. 13 for three frequencies between 293 MHz and 311 MHz with the signal generator connected to the dipole elements.
Figure 15:
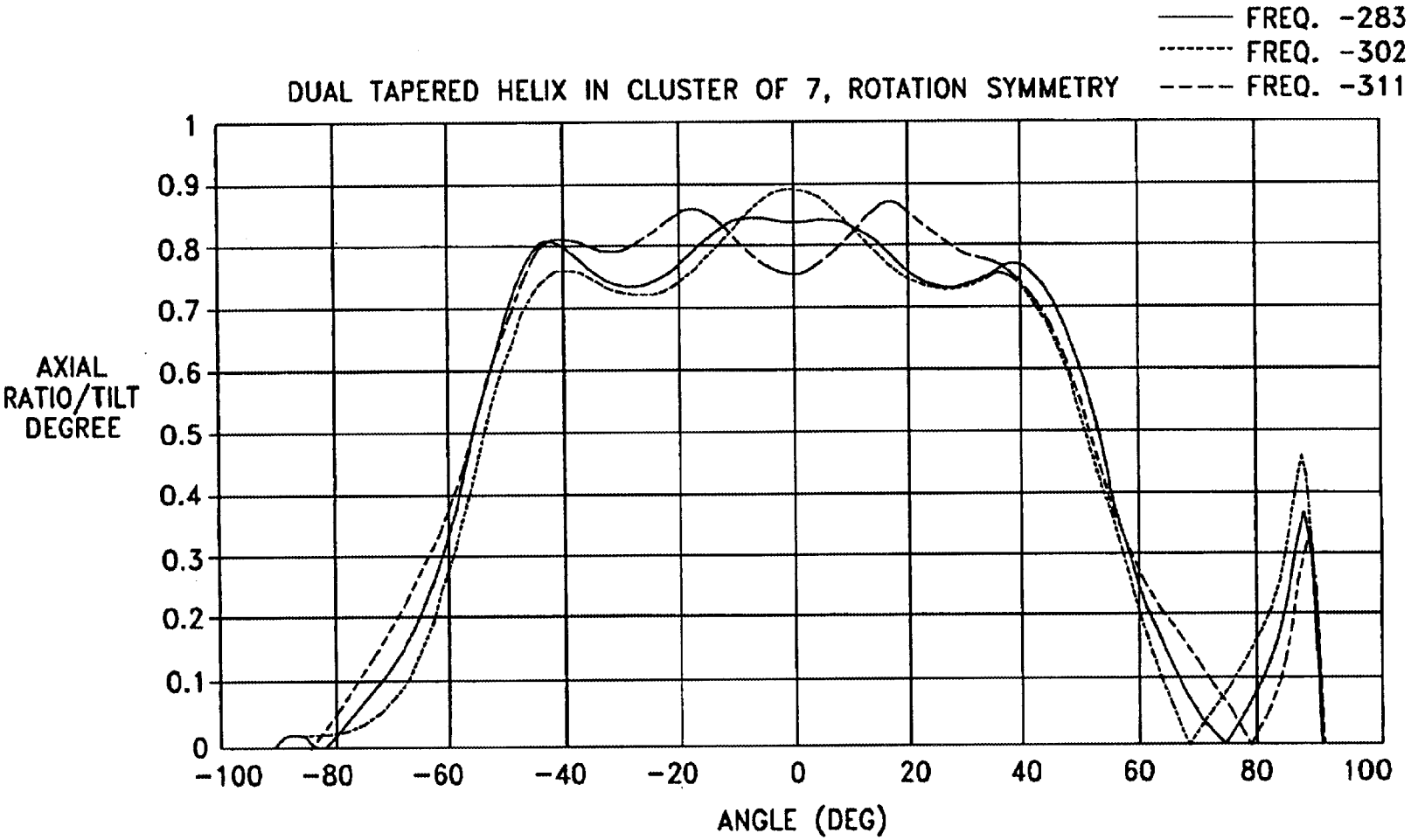
FIG. 15 is a graph illustrating the axial ratio as a function of angle at the same frequencies in FIG. 14.

FIG. 13 is a representation of the dual port helical antenna and dipole array with the helical elements 38 having various different rotational positions about their axes to thereby provide improved far field axial ratio. The graph in FIG. 14 represents calculated pattern diagrams of one helical element 38 in the cluster for three frequencies between 293 MHz and 311 MHz with the signal generator connected to dipole 44 and with a peak directivity between 7.5–9.5 dB. For the same excitation, FIG. 15 is a graph illustrating axial ratio as a function of angle at the same frequencies with a value between 0.77–0.91 at any of the frequencies.

Figure 16:
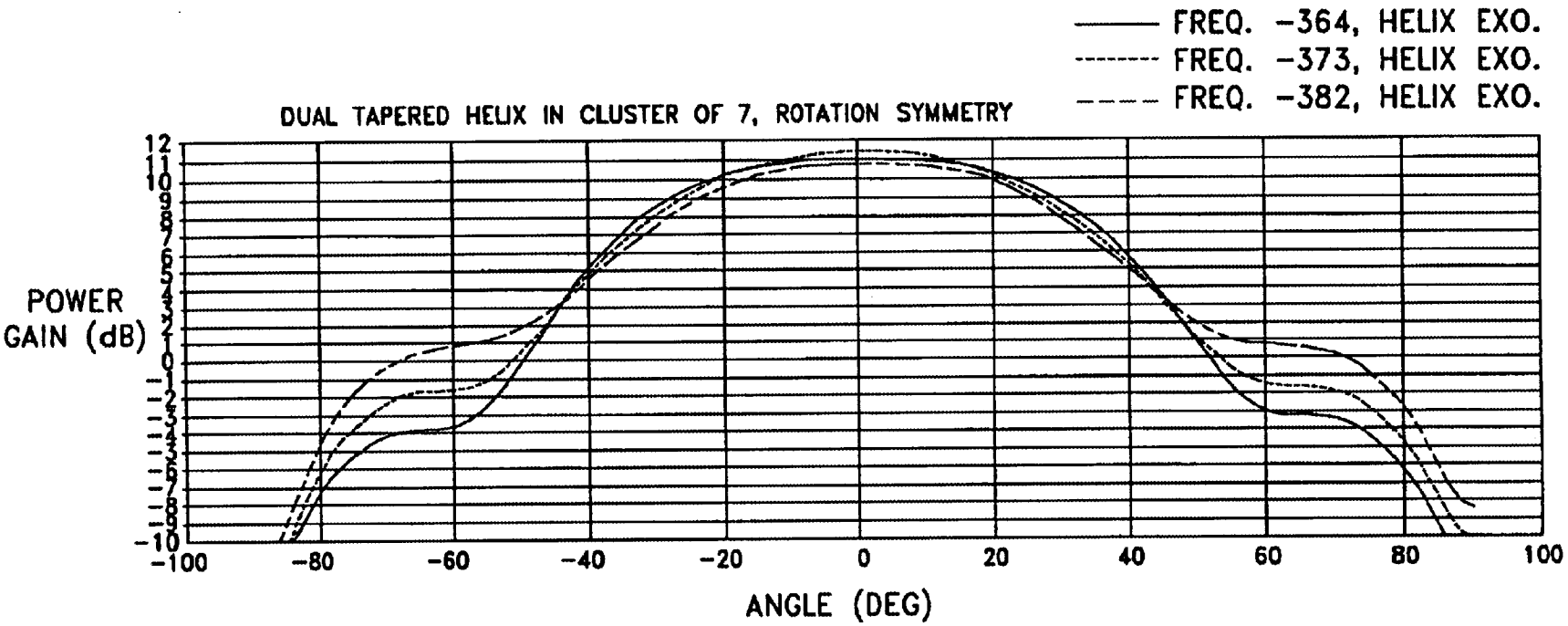
FIG. 16 is a graph illustrating calculated pattern diagrams of the helical element in FIG. 13 for three frequencies between 364 MHz and 382 MHz with the signal generator connected to the helical elements.
Figure 17:
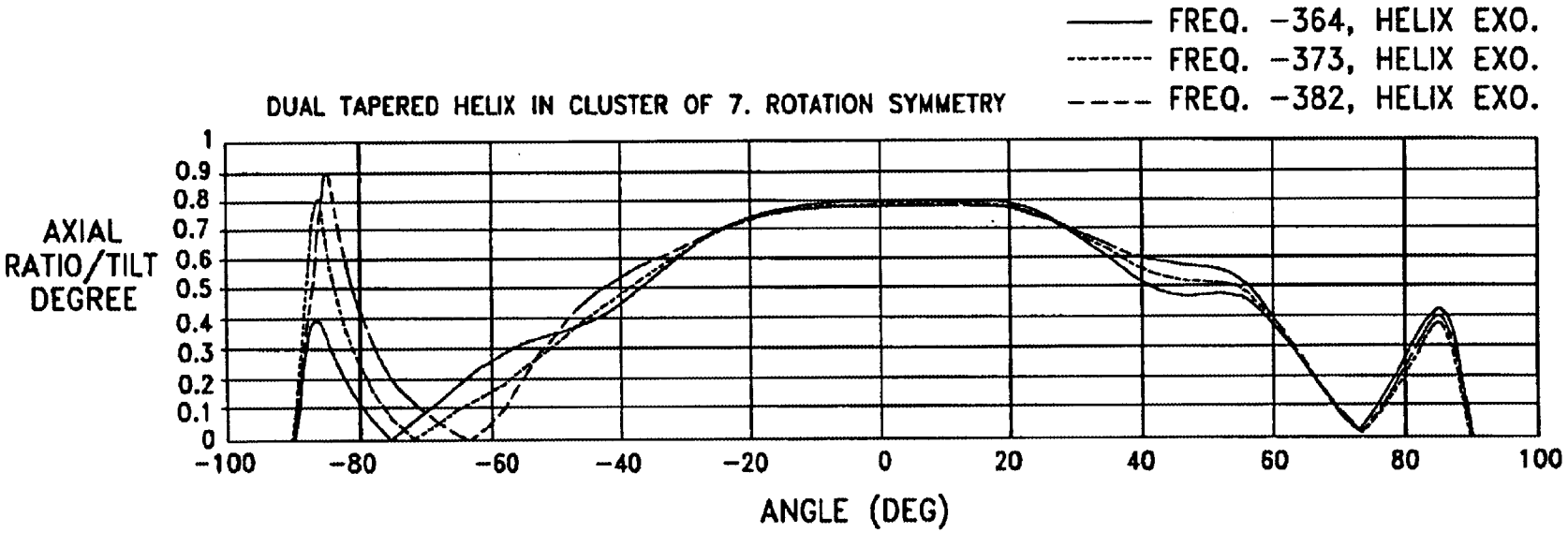
FIG. 17 is a graph illustrating the axial ratio as a function of angle at the same frequencies in FIG. 16.

FIG. 16 is a graph illustrating calculated patterns for helical element 38 at three frequencies between 364 MHz and 382 MHz with the signal generator connected to the port to the helical element with a peak directivity of about 11 dB. For the same excitation, FIG. 17 is a graph illustrating the axial ratio as a function of angle at the same frequencies with a value of above 0.8 at any of the frequencies.

There has been described a dual port helical antenna and array in which one port is connected to a helical antenna element and a second port is connected to a dipole antenna element. While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A dual port antenna comprising:

a) a support structure, b) a helical antenna element supported by the support structure, the helical antenna element having a feed end comprising a first port at the support structure and a distal end remote from the support structure, c) a dipole antenna element supported by the support structure and spaced from the support structure, the dipole element being positioned within a circumference formed by the helical antenna element and being spaced from the helical antenna element, and d) a connector to the dipole antenna element which comprises a second port.

2. The dual port antenna as defined by claim 1 wherein the connector comprises a balun/two-wire line.

3. The dual port antenna as defined by claim 2 wherein the support structure comprises a ground plane for the helical antenna element and the dipole antenna element.

4. The dual port antenna as defined by claim 3 wherein the ground plane is part of a printed circuit board, the balun/two-wire line being printed in the printed circuit board.

5. The dual port antenna as defined by claim 4 wherein the dipole antenna element comprises a Z-shaped dipole.

6. The dual port antenna as defined by claim 5 wherein the helical antenna element has uniform diameter around an axis of the helical element.

7. The dual port antenna as defined by claim 5 wherein the helical antenna element has a plurality of diameters around an axis of the helical element.

8. The dual port antenna as defined by claim 4 wherein the helical antenna element has uniform diameter around an axis of the helical element.

9. The dual port antenna as defined by claim 4 wherein the helical antenna element has a plurality of diameters around an axis of the helical element.

10. The dual port antenna as defined by claim 1 wherein the dipole antenna element comprises a Z-shaped dipole.

11. The dual port antenna as defined by claim 10 wherein the helical antenna element has uniform diameter around an axis of the helical element.

12. The dual port antenna as defined by claim 10 wherein the helical antenna element has a plurality of diameters around an axis of the helical element.

13. The dual port antenna as defined by claim 1 wherein the helical antenna element has uniform diameter around an axis of the helical element.

14. The dual port antenna as defined by claim 1 wherein the helical antenna element has a plurality of diameters around an axis of the helical element.

15. A dual port antenna array comprising:

a) a support structure, b) a plurality of helical antenna elements supported by the support structure, each helical antenna element having a feed end at the support structure and a distal end remote from the support structure, the feed ends connected in parallel as a first port, c) a plurality of dipole elements supported by the support structure and spaced from the support structure, the dipole elements being positioned within a respective circumference formed by the helical antenna elements and being spaced from the helical antenna elements, and d) a connector to the dipole elements which comprises a second port.

16. The dual port antenna array as defined by claim 15 wherein the support structure comprises a ground plane for the helical antenna elements and the dipole antenna elements.

17. The dual port antenna array as defined by claim 16 wherein the connector comprises a balun/two-wire line, the ground plane being part of a printed circuit board with the balun/two-wire line being printed in the printed circuit board.

18. The dual port antenna array as defined by claim 15 wherein the dipole antenna elements each comprise a Z-shaped dipole.

19. The dual port antenna array as defined by claim 15 wherein the helical antenna elements have uniform diameter around an axis of each helical element.

20. The dual port antenna array as defined by claim 15 wherein each helical antenna element has a plurality of diameters around an axis of the helical element.

21. The dual port antenna array as defined by claim 15 wherein the helical elements have identical rotational positions about their axes.

22. The dual port antenna array as defined by claim 15 wherein the helical antenna elements have different rotational positions about their axes.

* * * * *